US005797769A

United States Patent [19]

Yang et al.

[11] Patent Number: 5,797,769

[45] Date of Patent: Aug. 25, 1998

[54] ELECTRICAL CONNECTOR WITH BOARDLOCK

[75] Inventors: Tsung-Lin Yang; Jiunn-Ren Chen, both of Taipei, Taiwan

[73] Assignee: Molex Incorporated, Lisle, Ill.

[21] Appl. No.: 665,661

[22] Filed: Jun. 18, 1996

[30] Foreign Application Priority Data

May 14, 1996 [TW] Taiwan ..... 85207102

[51] Int. Cl.[6] ..... H01R 13/66

[52] U.S. Cl. ..... 439/571; 439/567

[58] Field of Search ..... 439/567, 571–575, 439/607, 92, 79, 95

[56] References Cited

U.S. PATENT DOCUMENTS

| | | | |
|---|---|---|---|
| 4,907,987 | 3/1990 | Douty et al. | 439/571 |
| 5,024,607 | 6/1991 | Klachlic | 439/567 |
| 5,137,245 | 8/1992 | Lee | 248/506 |
| 5,147,220 | 9/1992 | Lybrand | 439/567 |
| 5,238,413 | 8/1993 | McCaffrey et al. | 439/79 |
| 5,249,983 | 10/1993 | Hirai | 439/573 |

FOREIGN PATENT DOCUMENTS

0469845A1 7/1991 European Pat. Off. ..... H01R 9/09

*Primary Examiner*—Neil Abrams
*Assistant Examiner*—Eugene G. Byrd
*Attorney, Agent, or Firm*—Stacey E. Caldwell

[57] ABSTRACT

An electrical connector includes a dielectric housing having a front mating face, a rear terminating face, a bottom mounting face and a plurality of terminal-receiving passages extending rearwardly of the front mating face. A plurality of terminals are received in the passages. A stamped and formed metal boardlock is mounted on the housing and includes a generally planar mounting plate disposed generally parallel to the front mating face of the housing. A pair of locking legs are formed out of a bottom edge of the mounting plate and project below the bottom mounting face of the housing for insertion into an appropriate hole in the printed circuit board. One of the locking legs is generally coplanar with the mounting plate and has a locking portion formed generally perpendicular to the mounting plate and, in turn, perpendicular to the front mating face of the housing. The other locking leg is generally flat and L-shaped in a plane generally perpendicular to the mounting plate.

11 Claims, 3 Drawing Sheets

ELECTRICAL CONNECTOR WITH BOARDLOCK

FIELD OF THE INVENTION

This invention generally relates to the art of electrical connectors and, particularly, to an electrical connector for surface mounting on a printed circuit board.

BACKGROUND OF THE INVENTION

A conventional surface mount electrical connector includes a dielectric (plastic) housing having a plurality of terminal-receiving cavities or passages, with a plurality of terminals received in the passages. A metal shield often surrounds a substantial portion of the housing to protect at least the mating portions of the terminals from RF and EMI interference as well as protecting the surroundings from interference radiating from the connector, itself. The housing is surface mounted to a printed circuit board, and the terminals have tail portions for surface mounting to circuit pads on the circuit board or for insertion into holes in the board. These types of connectors often are called input/output (I/O) connectors.

Prior art input/output connectors typically have had problems in being relatively unbalanced because the plastic housing often has a forwardly extending mating portion in which contact portions of the terminals are positioned. This is particularly true with right-angled board-mounted connectors. For instance, one type of such electrical connector is called a D-Subminiature connector which has a forwardly extending projection of a generally D-shape. This D-shaped projection is surrounded by the metal shield which causes the center of gravity of the connector to be considerably forward and results in the connector being somewhat unbalanced or unstable.

In other words, right-angled board-mounted connectors, such as the D-Subminiature connectors, are asymmetrical and, therefore, can rock during the processing of the connector to the underlying printed circuit board, such as during soldering the tail portions of the terminals to the circuits on the board. This rocking can result in misalignment of the connector with respect to the circuit board or in the connector completely falling off the circuit board. Furthermore, right-angled connectors which have relatively high mating and unmating forces tend to rock and otherwise compromise the integrity of the solder joints during such mating and unmating.

In order to alleviate some of the problems associated with connectors as described above, particularly with right-angled connectors, through-hole boardlocks have been utilized to hold the connector with respect to the underlying printed circuit board. If retention forces between the connector and the printed circuit board are high, the insertion forces of the boardlock into a hole in the printed circuit board are correspondingly high and, accordingly, the force applied manually or robotically to insert the connector can cause damage to the connector, the boardlock, or the printed circuit board if there is misalignment or inaccurate placement. Furthermore, in orienting a boardlock in such a way as to prevent rocking in a mating direction (i.e. wherein board-engaging barbs are perpendicular to the mating face of the connector), the boardlock often occupies excessive real estate on the circuit board, and the connector and the boardlock assembly is not space efficient.

Therefore, it is important, particularly in right-angled connector applications, to accurately hold the connector to the printed circuit board during both processing of the connector to the board and thereafter, i.e. during mating and unmating of the connector, to assure the integrity of the ongoing connection of the connector to the printed circuit board. However, it also is important to have a relatively low insertion force connector between the boardlock and the printed circuit board to minimize the occurrence of damage to any of the components. The present invention is directed to providing a boardlock system to achieve these ends.

SUMMARY OF THE INVENTION

An object, therefore, of the invention is to provide a new and improved boardlock for a surface mount electrical connector, such as a right-angled connector.

In the exemplary embodiment of the invention, the connector includes a dielectric housing having a front mating face, a rear terminating face, a bottom mounting face and a plurality of terminal-receiving passages extending rearwardly of the front mating face. The bottom mounting face is adapted for surface mounting to a printed circuit board. A plurality of terminals are received in the passages. A stamped and formed metal boardlock is mounted on the housing and includes a generally planar mounting plate disposed generally parallel to the front mating face of the housing. A pair of locking legs are formed out of a bottom edge of the mounting plate and project below the bottom mounting face of the housing for insertion into a hole in the printed circuit board. At least one of the locking legs is generally coplanar with the mounting plate and has a locking portion formed generally perpendicular to the mounting plate and, in turn, perpendicular to the front mating face of the housing.

The other of said pair of locking legs is generally flat and L-shaped in a plane generally perpendicular to the mounting plate. Specifically, the other of the pair of locking legs includes a first portion projecting rearwardly of the mounting plate and a second portion projecting downwardly of a distal end of the first portion for insertion into the hole in the printed circuit board. The first and second portions are coplanar in a plane generally perpendicular to the mounting plate. The first portion is bent at a proximal end thereof in a direction generally parallel to the bottom mounting face of the dielectric housing.

As disclosed herein, the connector and its dielectric housing are elongated generally parallel to the mating face thereof. Preferably, one of the boardlocks is mounted at each opposite end of the elongated housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
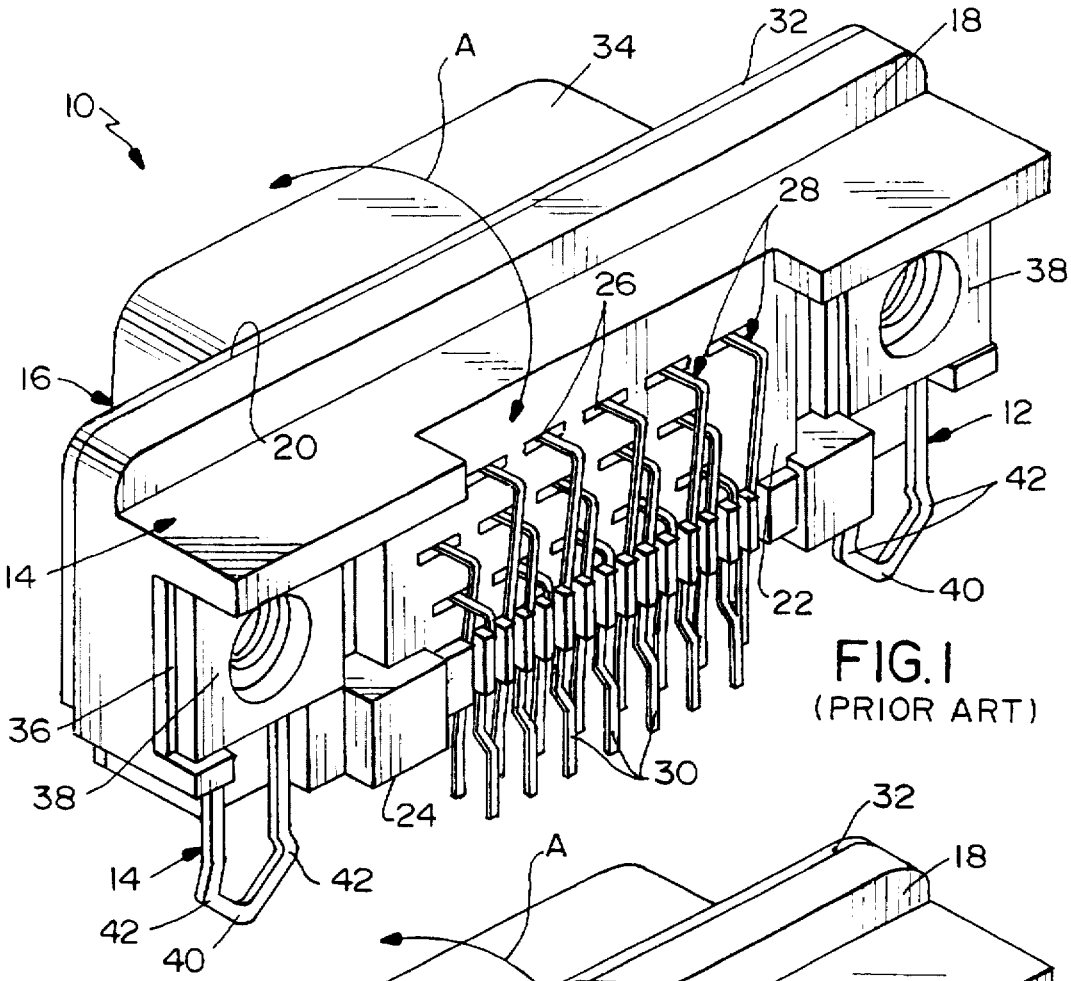
FIG. 1 (PRIOR ART)
FIG. 1 is a perspective view of the rear of an electrical connector incorporating one form of boardlock of the prior art.

Referring to the drawings in greater detail, and first to FIG. 1, an electrical connector, generally designated 10, incorporating a pair of boardlocks, generally designated 12, according to the prior art is shown. The connector is a shielded, surface mount connector adapted for mounting on a top surface of a printed circuit board. The connector includes two primary components, namely an elongated dielectric housing, generally designated 14, and a shield, generally designated 16. The housing is a unitary structure integrally molded of dielectric material such as plastic or the like. The shield is a unitary structure stamped and formed of sheet metal material.

More particularly, dielectric housing 14 of connector 10 includes a body portion having a flange 18 with a front mating face 20, a rear terminating face 22, a bottom mounting face 24 and a plurality of terminal-receiving passages 26 extending in a direction between the front mating face and the rear terminating face. A plurality of terminals, generally designated 28, are received in the passages. The terminals include downwardly depending tail portions 30 for insertion into a pattern of holes in the printed circuit board for soldering to circuit traces on the board and/or in the holes.

As stated above, shield 14 is a unitary structure stamped and formed of sheet metal material. The shield includes a main flange 32 that abuts against front mating 20 of housing 14. A shroud 34 projects forward of flange 32 and surrounds a mating portion of housing 14 and the contact portions of terminals 28 therewithin.

Therefore, electrical connector 10 is a typical right-angled surface mount electrical connector of a D-Subminiature type. Shroud 34 and the forwardly projecting mating portion of the housing are generally D-shaped, as is known in the art.

Each prior art boardlock 12 of connector 10 is stamped of sheet metal material and includes a square, generally planar mounting plate 36 held to the rear face of housing 14 by a T-bolt having a square head 38. A generally U-shaped locking leg 40 projects downwardly from mounting plate 36 and has outwardly projecting locking barbs 42. The locking leg is adapted for insertion into a mounting hole in the printed circuit board. Two of the boardlocks 12 are mounted at opposite ends of the elongated dielectric housing 14 of the connector. It can be seen that U-shaped locking leg 40 of each boardlock 12 is generally coplanar with mounting plate 36.

One of the problems with the prior art boardlocks 12 shown in FIG. 1 is best understood by reviewing the Background, above. As stated therein, right-angled connector 10 is relatively unbalanced and has a tendency to rock in a direction generally perpendicular to its mating face 20 both during processing of the connector to the printed circuit board (i.e. soldering terminals 28 to circuit traces on the board), as well as during mating and unmating of the connector with a complementary connector. This rocking motion is shown by double-headed arrow "A" in FIG. 1. With locking legs 40 of boardlocks 12 being generally coplanar with mounting plates 36 of the boardlocks, the locking legs have a tendency to bend when the connector rocks or is forced in the direction of double-headed arrow "A".

Figure 2:
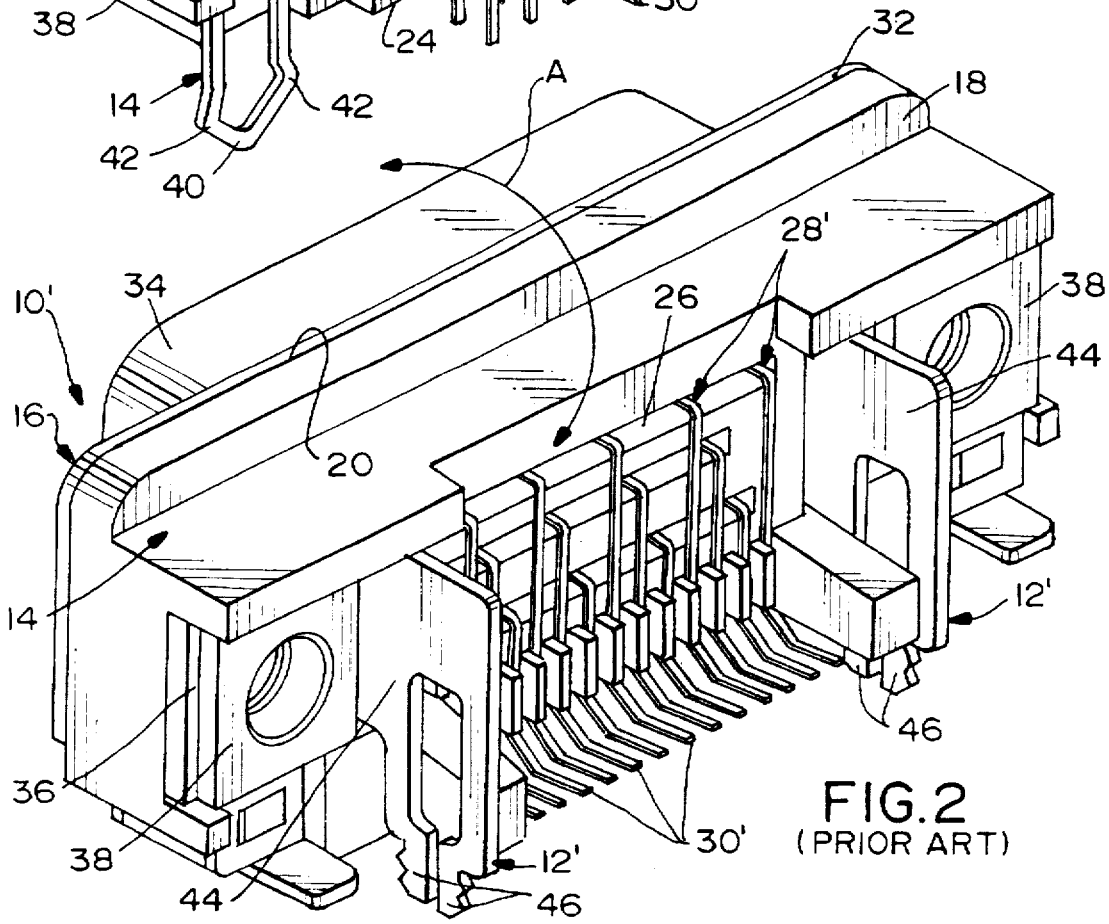
FIG. 2 (PRIOR ART)
FIG. 2 is a perspective view similar to that of FIG. 1, showing another form of boardlock of the prior art.

FIG. 2 shows an electrical connector 10' incorporating a different type of boardlock 12' according to the prior art. Connector 10' in FIG. 2 is substantially identical to connector 10 in FIG. 1, except for tail portions 30' of terminals 28' being surface mount tail portions rather than tail portions inserted into holes in the printed circuit board. Consequently, like numerals are applied in FIG. 2 to designate like components described above and shown in FIG. 1. Surface mount connectors, such as connector 10' using surface mount terminal tail portions 30', are less stable in the direction of double-headed arrow "A" than the unbalanced connector 10 in FIG. 1 with the through-hole terminal tail portions. Consequently, each boardlock 12' in FIG. 2 includes a bifurcated locking leg 44 having two leg portions 46 disposed in a plane generally perpendicular to the mounting plate 36 of the boardlock and, in turn, perpendicular to the front mating face 20 of the connector housing. With locking legs 44 being generally perpendicular to the mating face of the connector housing, the legs are generally coplanar in the direction of potential rocking movement of the connector. Therefore, the legs can resist this rocking movement significantly better than the boardlocks 12 in FIG. 1, which becomes increasingly important as forces, particularly those during mating and unmating increase. Unfortunately, by stamping and forming locking legs 44 at the sides of mounting plates 36 of boardlocks 12' (FIG. 2), considerable excess metal is wasted during stamping the boardlocks out of sheet metal material.

Figure 3:
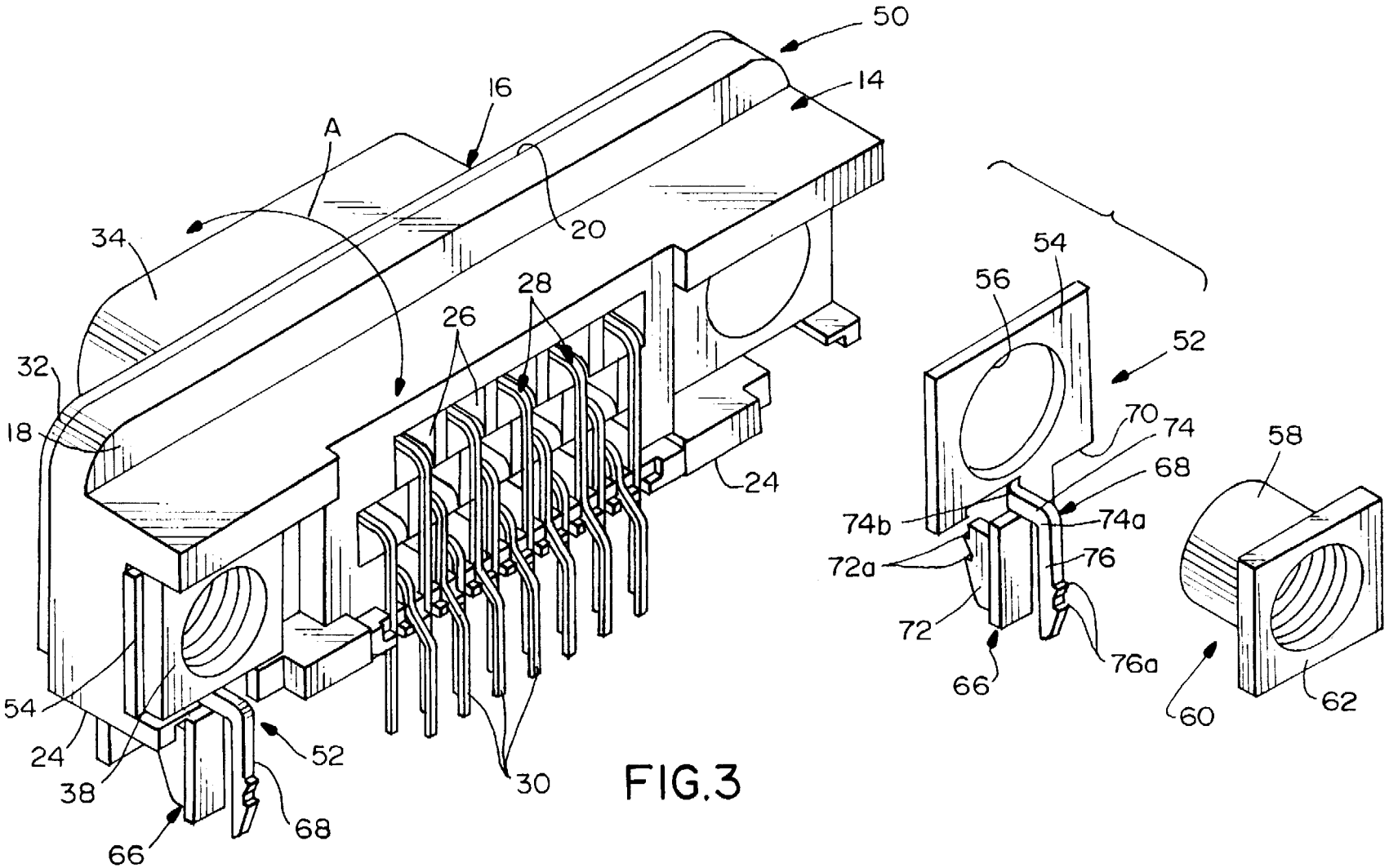
FIG. 3 is a perspective view of the rear of an electrical connector embodying the boardlocks of the present invention, with one of the boardlocks removed from the connector housing to facilitate the illustration.

FIG. 3 shows an electrical connector, generally designated 50, incorporating a pair of boardlocks, generally designated 52, according to the invention. Again, connector 50 is very similar to connector 10 described above and shown in FIG. 1 and, consequently, like numerals have been applied in FIG. 3 corresponding to like components described above in relation to connector 10 in FIG. 1.

More particularly, each boardlock 52 according to the invention is stamped and formed of sheet metal material and includes a square-shaped, generally planar mounting plate 54 adapted for mounting against the rear terminating face of housing 14 generally parallel to front mating face 20 of the housing. The mounting plate has a through hole 56 through which a shank portion 58 of a T-bolt 60 extends. The T-bolt is known in the art and includes a square head 62 for sandwiching mounting plate 54 between the head and the rear of the housing. Shank 58 is hollow and, in essence, comprises a rivet-type fastener which is deformed at its distal end in front of the connector housing to rigidly mount the boardlock.

Each boardlock 52 further includes a pair of locking legs, generally designated 66 and 68, formed out of a bottom edge 70 of mounting plate 54 and projecting below the bottom mounting face 24 of housing 14 for insertion into an appropriate mounting hole in the printed circuit board.

Locking leg 66 is coplanar with mounting plate 54 and has a locking portion 72 formed generally perpendicular to mounting plate 54 and, in turn, perpendicular to front mating face 20 of the connector housing. Locking portion 72 has a pair of forwardly projecting barbs **72*a***.

Generally, locking leg 68 is generally flat and L-shaped in a plane generally perpendicular to mounting plate 54. More particularly, locking leg 68 includes a first portion 74 projecting rearwardly of mounting plate 54 and a second portion 76 projecting downwardly of a distal end 74*a* of first portion 74. The second portion 76 is adapted for insertion into the mounting hole in the printed circuit board and includes a pair of rearwardly projecting barbs 76*a*. In essence, first and second portions 74 and 76, respectively, of locking leg 78 are coplanar in a plane generally perpendicular to mounting plate 54. First portion 74 of locking leg 68 is bent at a proximal end 74*b* thereof in a direction generally parallel to the bottom mounting face 24 of connector housing 14.

Figure 4:
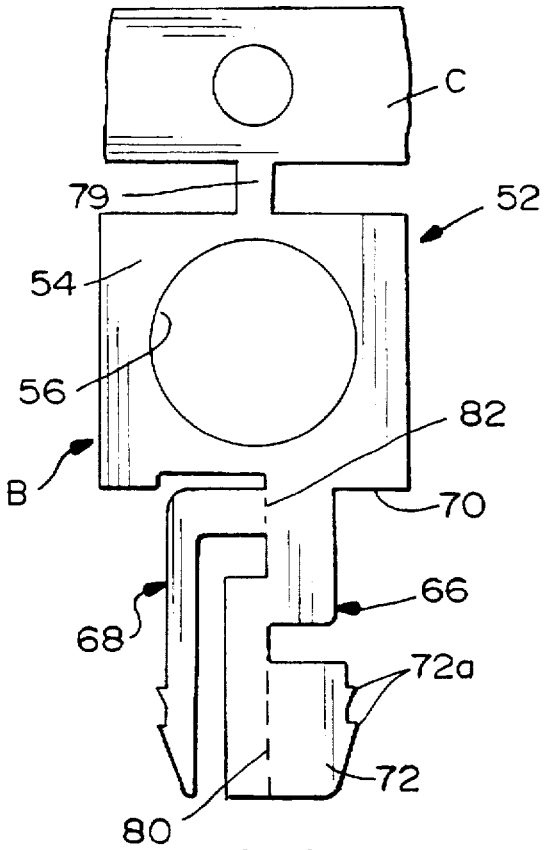
FIG. 4 is a plan view of one of the boardlocks of the invention stamped as a blank from a sheet of metal material, prior to forming.
Figure 5:
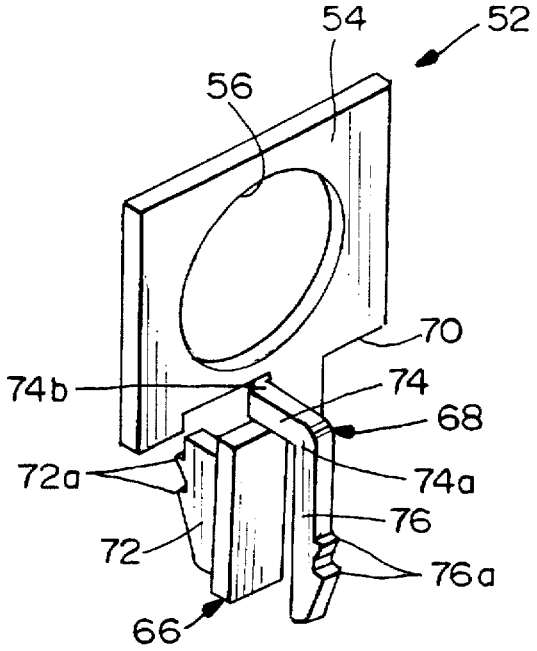
FIG. 5 is a perspective view of the blank of FIG. 4 having been formed into the configuration of the boardlock of the invention.

FIG. 4 shows a blank, generally designated "B", stamped of sheet metal material preparatory to forming one of the boardlocks 52. Blank "B" is connected by a web 79 to a carrier strip "C" which carries a series of blanks to a forming station or machine. It can be seen that all of the components of the boardlock, including mounting plate 54 and locking legs 66 and 68, are coplanar in the stamped blank form. In order to form blank "B" in FIG. 4 to the configuration of boardlock 52 in FIGS. 3 and 5, locking portion 72 of locking leg 66 simply is bent rearwardly, as at dotted line 80 (FIG. 4), and locking leg 68 simply is bent forwardly at dotted line 82. With those two simple bends, locking portion 72 of locking leg 66 and the entirety of locking leg 68 are in planes generally perpendicular to mounting plate 54. Since the mounting plate is generally parallel to the front mating face and the rear terminating face of the connector housing, locking portion 72 of locking leg 66 and the entirety of locking leg 68 are in planes generally perpendicular to the rocking motion of the connector as indicated by double-headed arrow "A" (FIG. 3). Consequently, the rocking motion is opposed by these perpendicular planar portions of the locking legs of the boardlocks.

It also should be seen in FIG. 4 that locking legs 66 and 68, being stamped from the bottom edge 70 of mounting plate 54, results in an efficient stamping operation which causes very little waste material. In other words, the boardlocks can be stamped as blanks "B" in very close side-by-side relationship along a strip of sheet metal material.

Figure 6:
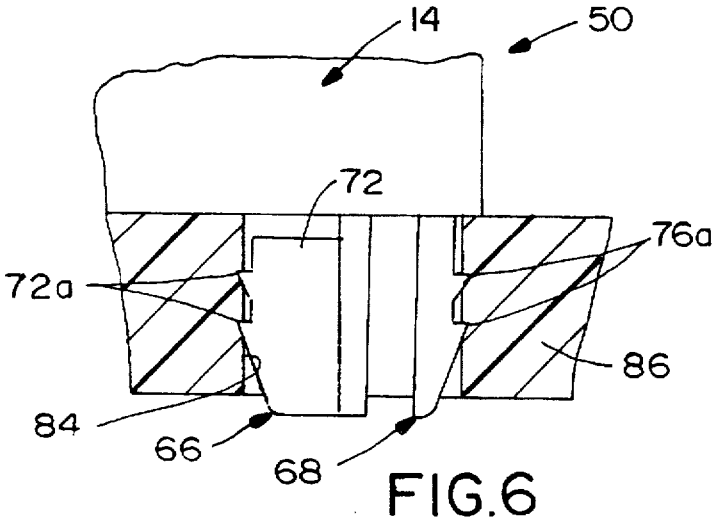
FIG. 6 is a fragmented vertical section through a portion of the connector housing and a printed circuit board to show the locking legs of the boardlock in position within a mounting hole in the board.

Lastly, FIG. 6 shows locking portion 72 (including barbs 72*a*) of locking leg 66 and the lower tip of locking leg 68 (including barbs 76*a*) inserted into a mounting hole 84 in a printed circuit board 86. It also should be understood that, while providing considerable resistance against rocking motion of the connector, the "bifurcated-leg" configuration of boardlocks 52 afford low insertion forces into the mounting holes in the printed circuit board, while the barbs provide excellent retention means.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector, comprising:

a dielectric housing having a front mating face, a rear terminating face, a bottom mounting face and a plurality of terminal-receiving passages extending rearwardly of the front mating face, the bottom mounting face being adapted for surface mounting to a printed circuit board;

a plurality of terminals received in said passages; and a stamped and formed metal boardlock mounted on the housing and including a generally planar mounting plate disposed generally parallel to the front mating face of the housing, a pair of locking legs formed out of a bottom edge of the mounting plate and projecting below the bottom mounting face of the housing for insertion into a hole in the printed circuit board, and at least one of the locking legs being generally coplanar with the mounting plate and having a locking portion formed generally perpendicular to the mounting plate and, in turn, perpendicular to the front mating face of the housing.

2. The electrical connector of claim 1 wherein the other of said pair of locking legs is generally flat and L-shaped in a plane generally perpendicular to the mounting plate.

3. The electrical connector of claim 2 wherein said other of the pair of locking legs includes a first portion projecting rearwardly of the mounting plate and a second portion projecting downwardly of a distal end of the first portion for insertion into the hole in the printed circuit board, the first and second portions being coplanar in a plane generally perpendicular to said mounting plate.

4. The electrical connector of claim 3 wherein said first portion of the other of said pair of locking legs is bent at a proximal end thereof in a direction generally parallel to the bottom mounting face of the dielectric housing.

5. The electrical connector of claim 1 wherein said dielectric housing includes a forwardly projecting mating portion.

6. The electrical connector of claim 1 wherein said dielectric housing is elongated, and including one of said boardlocks mounted at each opposite end of the elongated housing.

7. An asymmetrical electrical connector, comprising:

a dielectric housing having a front mating face, a rear terminating face, a bottom mounting face and a plurality of terminal-receiving passages extending rearwardly of the front mating face, the bottom mounting face being adapted for mounting to a printed circuit board;

a plurality of terminals received in said passages; and a stamped and formed metal boardlock mounted on the housing and including a generally planar mounting plate disposed generally parallel to the front mating face of the housing, a pair of locking legs formed out of a bottom edge of the mounting plate and projecting below the bottom mounting face of the housing for insertion into a hole in the printed circuit board, and at least one of the locking legs being generally flat and L-shaped in a plane generally perpendicular to the mounting plate.

8. The asymmetrical electrical connector of claim 7 wherein said other of the pair of locking legs includes a first portion projecting rearwardly of the mounting plate and a second portion projecting downwardly of a distal end of the first portion for insertion into the hole in the printed circuit board, the first and second portions being coplanar in a plane generally perpendicular to said mounting plate.

9. The asymmetrical electrical connector of claim 8 wherein said first portion of the other of said pair of locking legs is bent at a proximal end thereof in a direction generally parallel to the bottom mounting face of the dielectric housing.

10. The asymmetrical electrical connector of claim 7 wherein said dielectric housing includes a forwardly projecting mating portion.

11. The asymmetrical electrical connector of claim 7 wherein said dielectric housing is elongated, and including one of said boardlocks mounted at each opposite end of the elongated housing.

* * * * *